US012601255B2

(12) United States Patent
Liu et al.

(10) Patent No.: US 12,601,255 B2
(45) Date of Patent: Apr. 14, 2026

(54) INVERSION METHOD TO ESTIMATE FRACTURE PROPAGATION VELOCITY AND FRACTURE VOLUME WITH CROSS-WELL DISTRIBUTED FIBER-OPTIC STRAIN DATA BEFORE FRACTURE HIT

(71) Applicant: Schlumberger Technology Corporation, Sugar Land, TX (US)

(72) Inventors: Yongzan Liu, Cambridge, MA (US); Lin Liang, Cambridge, MA (US); Smaine Zeroug, Cambridge, MA (US)

(73) Assignee: Schlumberger Technology Corporation, Sugar Land, TX (US)

( * ) Notice: Subject to any disclaimer, the term of this patent is extended or adjusted under 35 U.S.C. 154(b) by 0 days.

(21) Appl. No.: 18/652,499

(22) Filed: May 1, 2024

(65) Prior Publication Data

US 2024/0368984 A1 Nov. 7, 2024

Related U.S. Application Data

(60) Provisional application No. 63/499,317, filed on May 1, 2023.

(51) Int. Cl.
*E21B 43/26* (2006.01)
*E21B 49/00* (2006.01)

(52) U.S. Cl.
CPC ..... *E21B 49/006* (2013.01); *E21B 43/26* (2013.01)

(58) Field of Classification Search
CPC ..... E21B 49/006; E21B 43/26
See application file for complete search history.

(56) References Cited

U.S. PATENT DOCUMENTS

| | | | | |
|---|---|---|---|---|
| 8,789,587 | B2 * | 7/2014 | Tubel | E21B 47/017 166/266 |
| 11,041,382 | B2 * | 6/2021 | Bland | E21B 49/006 |
| 11,193,367 | B2 * | 12/2021 | Jin | E21B 47/107 |
| 11,230,915 | B2 * | 1/2022 | Dusterhoft | G01V 8/16 |
| 11,396,808 | B2 * | 7/2022 | Jaaskelainen | E21B 41/00 |
| 11,500,122 | B2 * | 11/2022 | Jaaskelainen | G06F 17/18 |
| 11,549,369 | B1 * | 1/2023 | LeBlanc | G01L 1/242 |
| 11,768,307 | B2 * | 9/2023 | Jin | E21B 47/107 702/6 |
| 11,828,171 | B2 * | 11/2023 | Lim Chen Ning | E21B 49/008 |

(Continued)

OTHER PUBLICATIONS

Branch, M. A. et al., "A Subspace, Interior, and Conjugate Gradient Method for Large-scale Bound-constrained Minimization Problems", SIAM Journal on Scientific Computing, 1999, vol. 21, No. 1. pp. 1-23.

*Primary Examiner* — Kenneth L Thompson
(74) *Attorney, Agent, or Firm* — Jeffrey D. Frantz

(57) ABSTRACT

Systems and methods are provided to obtain fracture parameters of a hydraulic fracturing operation using strain data obtained before a fracture hit. A system may include a strain sensor and processing circuitry. The strain sensor may be disposed downhole in a monitoring well and may obtain strain data while a fracture caused by a hydraulic fracturing operation propagates from a treatment well toward the monitoring well before a fracture hit occurs in the monitoring well. The processing circuitry may perform an inversion based on the strain data to estimate fracture parameters associated with the propagation of the fracture before the fracture hit.

17 Claims, 6 Drawing Sheets

(56) References Cited

U.S. PATENT DOCUMENTS

| | | | | |
|---|---|---|---|---|
| 11,913,314 | B2 * | 2/2024 | Korkin | E21B 43/26 |
| 11,913,330 | B2 * | 2/2024 | Moos | E21B 49/006 |
| 11,970,939 | B2 * | 4/2024 | Schaeffer | G06T 7/0004 |
| 12,461,267 | B2 * | 11/2025 | Dawson | G01V 1/50 |
| 2021/0088685 | A1 * | 3/2021 | Zheng | E21B 47/00 |
| 2021/0364669 | A1 * | 11/2021 | Dusterhoft | E21B 49/00 |
| 2024/0240556 | A1 * | 7/2024 | Narhi | E21B 49/00 |

* cited by examiner

INVERSION METHOD TO ESTIMATE FRACTURE PROPAGATION VELOCITY AND FRACTURE VOLUME WITH CROSS-WELL DISTRIBUTED FIBER-OPTIC STRAIN DATA BEFORE FRACTURE HIT

CROSS REFERENCES

This application claims the benefit of U.S. Provisional Patent App. No. 63/499,317, "Inversion Method to Estimate Fracture Propagation Velocity and Fracture Volume with Cross-Well Distributed Fiber-Optic Strain Data before Fracture Hit," filed May 1, 2023, the complete disclosure of which is hereby incorporated herein by reference.

BACKGROUND

The present disclosure generally relates to measuring parameters of hydraulic fracturing operations in a treatment well based on downhole fiber-optic strain data from a monitoring well.

This section is intended to introduce the reader to various aspects of art that may be related to various aspects of the present techniques, which are described and/or claimed below. This discussion is believed to be helpful in providing the reader with background information to facilitate a better understanding of the various aspects of the present disclosure. Accordingly, it should be understood that these statements are to be read in this light, and not as admissions of any kind.

Producing hydrocarbons from a wellbore drilled into a geological region is a remarkably complex endeavor. In many cases, decisions involved in hydrocarbon exploration and production may be informed by measurements from downhole well-logging tools that are conveyed deep into the wellbore. A variety of well treatment techniques may be used to increase the extraction of hydrocarbons from geological formations. Hydraulic fracturing, for example, introduce fractures that can enhance permeability of rocks greatly by connecting pores together. Thus, fractures can be induced mechanically in some reservoirs to boost hydrocarbon flow. Indeed, hydraulic fracturing may be performed to break down a geological formation and create fractures around a wellbore by pumping fluid at relatively high pressures (e.g., pressure above the determined closure pressure of the formation). This may increase production rates from a hydrocarbon reservoir.

In some cases, a treatment well may undergo hydraulic fracturing while an adjacent monitoring well may be used to determine when a fracture has extended from a perforation site in the treatment well and into the monitoring well. This may be referred to as a "fracture hit." Models have been developed to estimate a state of a hydraulic fracturing operation, but it is otherwise unknown during the time from the start of the perforation to the fracture hit. As such, many hydraulic fracturing operations may be conducted without knowledge of the current state of fracture formation until a fracture hit has occurred.

SUMMARY

A summary of certain embodiments disclosed herein is set forth below. It should be understood that these aspects are presented merely to provide the reader with a brief summary of these certain embodiments and that these aspects are not intended to limit the scope of this disclosure. Indeed, this disclosure may encompass a variety of aspects that may not be set forth below.

This disclosure relates to using fiber-optic strain data from a monitoring well to identify evolutions of fracture half-length, propagation velocity, fracture volume, and/or fracturing efficiency of a hydraulic fracturing operation in an adjacent treatment well. This useful information may be obtained from the strain data even before a fracture hit from a fracture extending from the treatment well into the monitoring well has occurred. Operators thus may adjust fracturing operations based on these measurements. Moreover, this unique field evidence can guide modeling efforts to incorporate this important physical behavior into fracture models, and the secondary information gathered, including fracture cross-section area and volume, can help evaluate and optimize fracturing efficiency.

Indeed, fluid-driven fracture propagation in subsurface geological media is a complex process, which involves fluid flow, rock deformation, and crack evolution. However, directly observing the process of fracture propagation is difficult. To address this issue, low-frequency (e.g., <0.05 Hz) distributed acoustic sensing (LF-DAS) may be applied to perform fracture monitoring. By installing a fiber along an offset monitoring well, strain variations in subsurface formation induced by a propagating fracture stimulated from the treatment well can be recorded. In this disclosure, an iterative inversion method may be used to interpret the strain data, which results in an indication of the evolving fracture geometry. The inversion results reveal useful information that the fracture tip advancement is not continuous, but rather intermittent, especially after the fracture has propagated a certain distance. This result provides field evidence to support the development and improvement of fracturing models. Moreover, the inversion method can provide additional fracture parameters such as the fracture cross-section area and volume. These parameters can be used to evaluate and improve the efficiency of the fracturing process. For example, pumping rate or pumping pressure may be adjusted based on the propagation of the fracture. In one particular example, when a fracture is detected to have slowed or stopped propagating, pumping rate or pumping pressure may be increased or pumping may be paused or stopped and a new perforation site may be chosen.

For example, a system may include a strain sensor and processing circuitry. The strain sensor may be disposed downhole in a monitoring well and may obtain strain data while a fracture caused by a hydraulic fracturing operation propagates from a treatment well toward the monitoring well before a fracture hit occurs in the monitoring well. The processing circuitry may perform an inversion based on the strain data to estimate fracture parameters associated with the propagation of the fracture before the fracture hit.

In another example, a method may include positioning a fiber-optic strain sensor in a monitoring well and obtaining strain data while performing a hydraulic fracturing operation in a treatment well. An inversion may be performed on a portion of the strain data from the fiber-optic strain sensor obtained between a fracture perforation of the treatment well and a fracture hit of the monitoring well. The results of the inversion may be used to obtain fracture parameters of the hydraulic fracturing operation.

In another example, an article of manufacture including one or more tangible, non-transitory, machine-readable media may include instructions that, when executed by one or more processors, cause the one or more processors to: receive strain data obtained in a monitoring well before a fracture hit of the monitoring well from a hydraulic fracturing operation of a treatment well and perform an inversion, based on the strain data obtained in the monitoring well before the fracture hit, to estimate a fracture half-length, a fracture propagation velocity, a fracture cross-section area, a fracture volume, or a fracturing fluid efficiency, or some combination thereof.

BRIEF DESCRIPTION OF THE DRAWINGS

Various aspects of this disclosure may be better understood upon reading the following detailed description and upon reference to the drawings in which.

DETAILED DESCRIPTION

Figure 1:
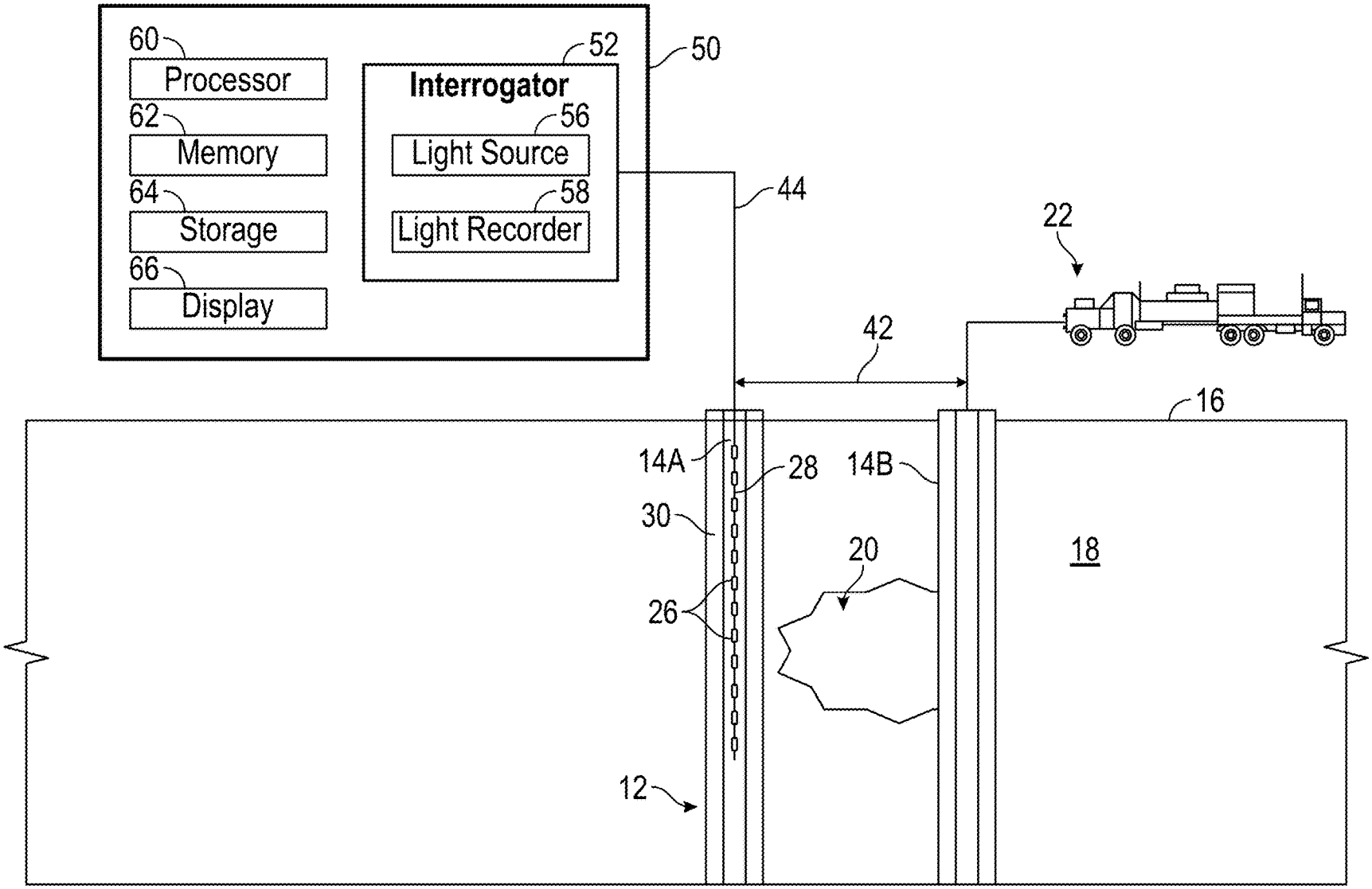
FIG. 1 is a schematic diagram of one example of a hydraulic fracturing monitoring system that may identify evolutions of fracture half-length, propagation velocity, fracture volume, and/or fracturing efficiency of a hydraulic fracturing operation in an adjacent treatment well.

One or more specific embodiments of the present disclosure will be described below. These described embodiments are only examples of the presently disclosed techniques. Additionally, in an effort to provide a concise description of these embodiments, all features of an actual implementation may not be described in the specification. It should be appreciated that in the development of any such actual implementation, as in any engineering or design project, numerous implementation-specific decisions must be made to achieve the developers' specific goals, such as compliance with system-related and business-related constraints, which may vary from one implementation to another. Moreover, it should be appreciated that such a development effort might be complex and time consuming, but would nevertheless be a routine undertaking of design, fabrication, and manufacture for those of ordinary skill having the benefit of this disclosure.

When introducing elements of various embodiments of the present disclosure, the articles "a," "an," and "the" are intended to mean that there are one or more of the elements. The terms "comprising," "including," and "having" are intended to be inclusive and mean that there may be additional elements other than the listed elements. Additionally, it should be understood that references to "one embodiment" or "an embodiment" of the present disclosure are not intended to be interpreted as excluding the existence of additional embodiments that also incorporate the recited features. As used herein, the terms "connect", "connection", "connected", "in connection with", and "connecting" are used to mean "in direct connection with" or "in connection with via one or more elements"; and the term "set" is used to mean "one element" or "more than one element". Further, the terms "couple", "coupling", "coupled", "coupled together", and "coupled with" are used to mean "directly coupled together" or "coupled together via one or more elements". As used herein, the terms "up" and "down"; "upper" and "lower"; "top" and "bottom"; and other like terms indicating relative positions to a given point or element are utilized to more clearly describe some elements. Commonly, these terms relate to a reference point at the surface from which drilling operations are initiated as being the top point and the total depth being the lowest point, wherein the well (e.g., wellbore, borehole) is vertical, horizontal or slanted relative to the surface.

In addition, as used herein, the term "real time" describes operations (e.g., computing operations) that are performed without significant human-perceivable interruption between operations. For example, data relating to the systems of this disclosure may be collected, transmitted, and/or used in control computations substantially in real time such that, as the data are collected, operations on the data may be performed quickly enough to provide feedback on the present state of well exploration, treatment, or production that the results may be used by operators to adjust well exploration, treatment, or production operations. Data readings, data transfers, and/or data processing steps may occur once every minute, once every second, once every 0.1 second, once every 0.01 second, or even more frequent, during operations of the systems (e.g., while the systems are operating). In addition, as used herein, the terms "automatic" and "automated" describe operations that are performed are caused to be performed, for example, by a process control system (e.g., solely by the process control system without human intervention).

This disclosure posits that the portion of data before fracture hit captures the evolution of fracture tip, which can provide field evidence on how the fracture propagates in the subsurface. A new approach to estimating fracture propagation characteristics is provided using low-frequency distributed acoustic sensing (LF-DAS). Specifically, a gradient-based inversion algorithm may use direct far-field fracture-induced strain variations to estimate the evolution of the fracture tip. This method represents a novel approach to analyzing LF-DAS data before fracture hit and may provide unique insights obtained directly from precise field measurements into the mechanics of hydraulic fracturing. For example, using fiber-optic strain data from a monitoring well may be used to identify evolutions of fracture half-length, propagation velocity, fracture volume, and fracturing efficiency of a hydraulic fracturing operation in an adjacent treatment well, even before a fracture hit has occurred. These insights may come in real time during a hydraulic fracturing operation or afterward. In either case, operators thus may adjust fracturing operations based on these insights.

Recent developments of optical fiber-based strain sensing technologies such as Low-Frequency Distributed Acoustic Sensing (LF-DAS) use fiber-optic cables as dense strain sensor arrays, therefore providing the oil and gas industry with new options for strain and seismic sensing. For instance, an LF-DAS may provide higher sensor count, more flexible deployment, and long-term operation capability in comparison to particle motion sensors such as geophones and accelerometers.

An LF-DAS sensor array 12 may be used to monitor a hydraulic fracturing operation, as shown in FIG. 1. The LF-DAS sensor array 12 may be deployed in a monitoring well 14A that is drilled from a surface 16 into a geological formation 18 to be adjacent to a treatment well 14B. The LF-DAS sensor array 12 in the monitoring well 14A may be used to monitor a hydraulic fracturing operation 20 performed on the treatment well 14B using any suitable hydraulic fracturing equipment 22.

The LF-DAS sensor array 12 includes fiber-optic sensors 26 that may measure strain in the geological formation 18 caused by the hydraulic fracturing operation 20. For example, an optical fiber cable 28 may enclose the fiber-optic sensors 26 to provide protection in a harsh borehole environment. The optical fiber cable 28 may include one or more optical fibers on which the fiber-optic sensors 26 are distributed. The one or more optical fibers may be single mode or multi-mode optical fibers. In one embodiment, the fiber-optic sensors 26 may be integrated into the one or more optical fibers using technologies such as distributed Bragg reflector (DBR) that may cause a partial reflection of an optical wave along the optical fiber cable 28. The optical fiber cable 28 may include one or more claddings to provide protections for the one or more optical fibers.

In the example of FIG. 1, the monitoring well 14A and the treatment well 14B are shown to be cased wells having casings 30, but the casings 30 may be absent or may not extend the full depths of the wells 14A and 14B. Indeed, the wells 14A and 14B may be cased wells or open wells. The borehole casings 30 may include pipes lowered into an open well and cemented in place. The borehole casings 30 may withstand a variety of forces, such as collapse, burst, and tensile, as well as chemically aggressive brines. The treatment well 14B may be separated from the monitoring well 14A by any suitable well-spacing distance 42. Moreover, the well-spacing distance 42 may vary with well depth.

The LF-DAS sensor array 12 may be connected to a wireline cable 44, which may be further connected to a control system 50. The control system 50 may control operations of the LF-DAS sensor array 12, provide certain signal sources (e.g., light source for the fiber-optic sensors 26), and receive and process the data acquired by the LF-DAS sensor array 12. The control system 50 may also control aspects of the hydraulic fracturing operation 20 (e.g., by controlling slurry pressure or flowrate from the hydraulic fracturing equipment 22).

An interrogator 52 of the control system 50 may provide a light source (e.g., laser) and light detection (e.g., detection of back-scattered light signals from the fiber-optic sensors 26). The optical fiber cable 28, the interrogator 52, and the other relevant devices or components (e.g., power supplies, control circuitry, cables) may form a Rayleigh scattering based Distributed Acoustic Sensing (DAS) system, which may use the optical fiber cable 28 to provide a distributed strain sensing. That is, the optical fiber cable 28 itself may act a sensing element, therefore enabling a higher sensor count (e.g., densely distributed fiber-optic sensors 26), more flexible deployment (e.g., flexibility of the optical fiber cable 28), and long-term operation capability (e.g., durability of the optical fiber cable 28) in comparison to other strain sensors. Using the LF-DAS sensor array 12 thus may enable strain signals to be detected over large distances (e.g., a length of the well) and in harsh environments (e.g., a borehole environment).

The interrogator 52 may include a light source 56 that may provide source light signals (e.g., laser impulses) for the fiber-optic sensors 26. For example, the light source 56 may include wavelength tunable lasers (e.g., semiconductor lasers), such as distributed Bragg reflector (DBR) laser, vertical cavity surface-emitting laser (VCSEL), external cavity laser, distributed feedback (DFB) laser, or other suitable lasers. The interrogator 52 may also include a light recorder 58 that may receive light signals (e.g., back scattered light signals associated with local measurement of dynamic strains caused by incident seismic wavefields) from the fiber-optic sensors 26, convert the light signals to electrical signals (e.g., using photodetectors), and further convert (e.g., digitalize) the electrical signals into the fiber sensor data. The photodetectors may include a PIN photodiode (e.g., InGaAs PIN, GaAs PIN, or Si PIN), an avalanche photodiode (e.g., InGaAs avalanche, GaAs avalanche, or Si avalanche), or any other suitable photodetector (e.g., Schottky, GaP, Ge, InAs, InAsSb, or HgCdTe photodiode).

The control system 50 may include the interrogator 52, a processor 60, a memory 62, a storage 64, and a display 66. The interrogator 52 may receive light signals from the fiber-optic sensors 26 and convert the light signals into fiber sensor data. The processor 60 may receive the fiber sensor data and apply an inversion to identify a variety of characteristics of the hydraulic fracturing operation 20 even before a fracture hit occurs, which represents the point in time at which a fracture of the hydraulic fracturing operation 20 reaches the monitoring well 14A. Data analysis and data processing based on received data may be executed by the processor 60 using processor-executable code stored in the memory 62 and the storage 64. The analyzed and processed data may be stored in the storage 64 for later usage. Analytic and processing results may be displayed via the display 66. Based on the analytic and processing results, the processor 60 may issue commands to the hydraulic fracturing equipment 22 (e.g., via a communication interface) to adjust the hydraulic fracturing operation and/or may generate a notification to a user (e.g., a well operator) based on the analytic and processing results.

The processor 60 may be any type of computer processor or microprocessor capable of executing computer-executable code. The processors 60 may include single-threaded processor(s), multi-threaded processor(s), or both. The processors 60 may also include hardware-based processor(s) each including one or more cores. The processors 60 may include general purpose processor(s), special purpose processor(s), or both. The processors 60 may be communicatively coupled to other internal components (such as interrogator 52, memory 62, storage 64, and display 66).

The memory 62 and the storage 64 may be any suitable articles of manufacture that can serve as media to store processor-executable code, data, or the like. These articles of manufacture may represent computer-readable media (e.g., any suitable form of memory or storage) that may store the processor-executable code used by the processor 60 to perform the presently disclosed techniques. The memory 62 and the storage 64 may also be used to store data described (e.g., fiber-optic strain data) and various other software applications for data analysis and data processing. The memory 62 and the storage 64 may represent non-transitory computer-readable media (e.g., any suitable form of memory or storage) that may store the processor-executable code used by the processor 60 to perform various techniques described herein. It should be noted that the components of the control system 50 are described by way of example and that the control system 50 may include additional or fewer components.

Figure 2:
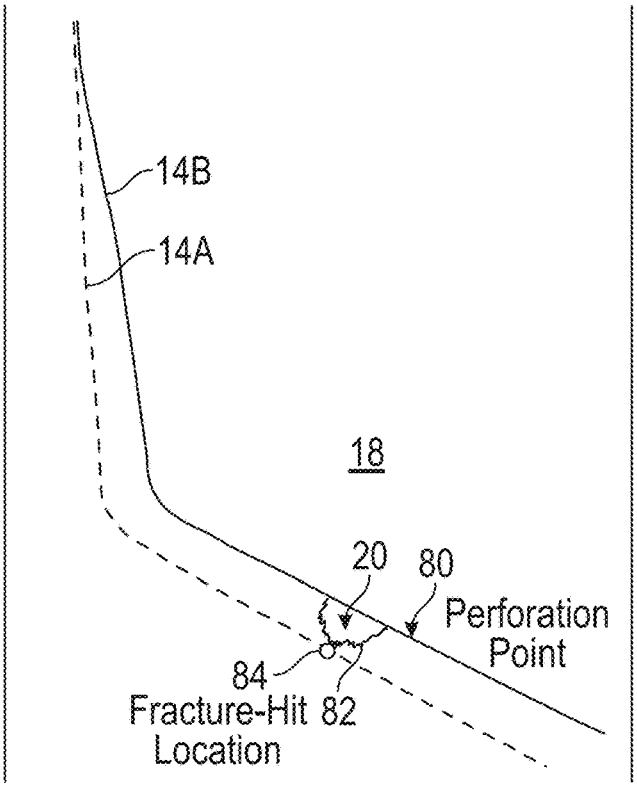
FIG. 2 is a schematic diagram of an example of a hydraulic fracturing monitoring operation using horizontal wells.

The monitoring well 14A and treatment well 14B may be horizontal wells, as shown in FIG. 2. The hydraulic fracturing operation 20 may start at a perforation point 80 in the treatment well 14B at a perforation time. As the hydraulic fracturing operation 20 continues, a fracture 82 may extend through the geological formation 18 until it reaches a fracture-hit location 84 in the monitoring well 14A at a fracture-hit time. Yet even before the fracture hit, the LF-DAS sensor array 12 may collect strain data corresponding to the characteristics of the state of the hydraulic fracture operation 20. As discussed further below, an inversion may be applied to the strain data to obtain fracture parameters relating to the characteristics of the state of the hydraulic fracture operation 20.

Figure 3:
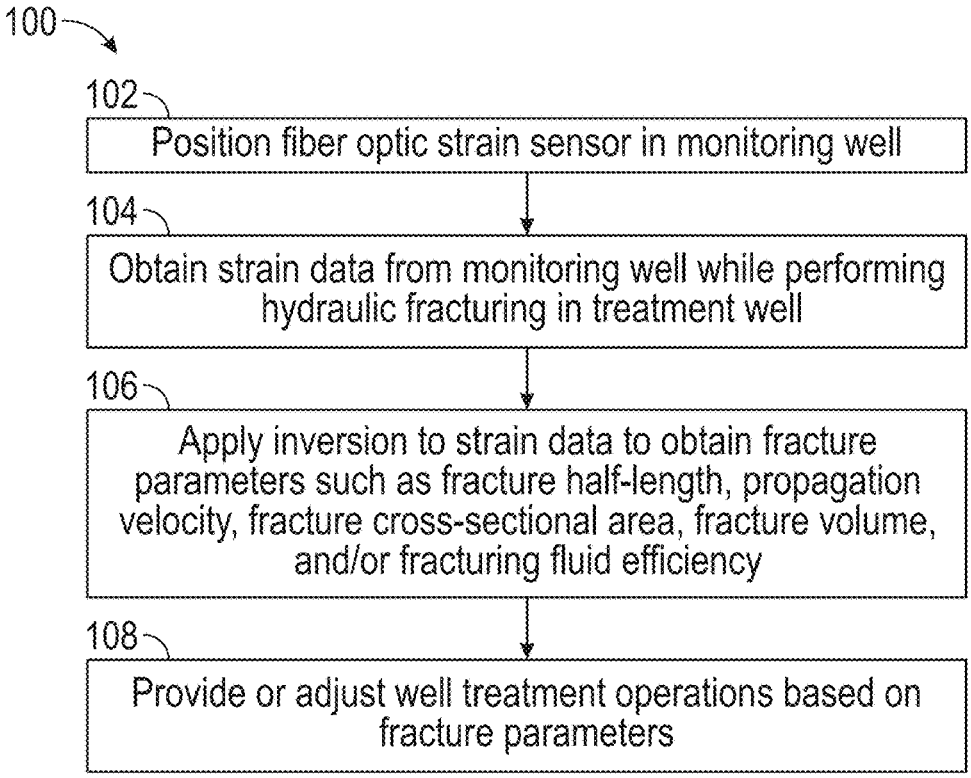
FIG. 3 is a flowchart of a method for performing hydraulic fracturing operation using the hydraulic fracturing monitoring system evolutions of fracture half-length, propagation velocity, fracture volume, and/or fracturing efficiency before fracture hit.

A flowchart 100 of FIG. 3 illustrates one manner of using the LF-DAS sensor array 12 to identify characteristics of the state of the hydraulic fracture operation 20 even before a fracture hit occurs. Any suitable strain sensor (e.g., the LF-DAS sensor array 12) may be positioned downhole in the monitoring well 14A (block 102). While performing a hydraulic fracturing operation, the strain sensor may be used to obtain strain data (block 104). An inversion may be applied to the strain data based on any suitable fracturing model to obtain fracture parameters such as fracture half-length, propagation velocity, fracture cross-sectional area, fracture volume, and/or fracturing fluid efficiency (block 106). By way of example, the inversion may be computed using the processor 60 of the control system 50 or using any other suitable computing device (e.g., a computing device of the hydraulic fracturing equipment 22, a personal computer of an operator, a remote cloud computer). An operator may adjust current hydraulic fracturing operations or plan for future hydraulic fracturing operations based on the insight provided by the fracture parameters (block 108). For example, pumping rate or pumping pressure may be adjusted based on the propagation of the fracture. In one particular example, when a fracture is detected to have slowed or stopped propagating, pumping rate or pumping pressure may be increased or may be paused or stopped and a new perforation site may be chosen for propagating a different fracture at a different station in the treatment well 14B.

Figure 4:
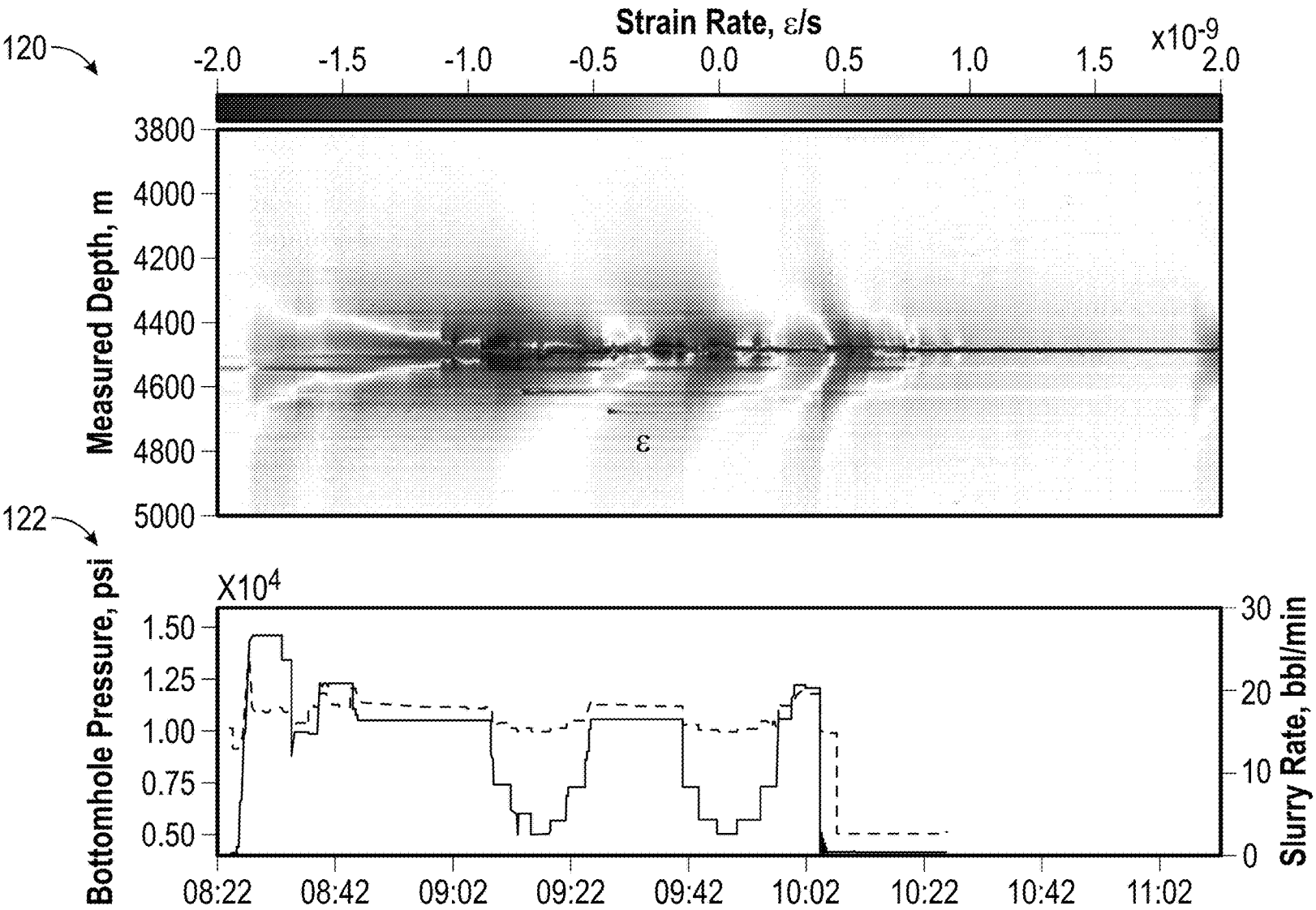
FIG. 4 is a collection of plots showing fiber-optic strain rate waterfall measured from a monitoring well compared to a pumping schedule for a single-cluster hydraulic fracturing treatment in a treatment well.

Inversion of the strain data may be performed using any suitable techniques using any suitable processing circuitry (e.g., the processor 60 of the control system 50, a computing device of the hydraulic fracturing equipment 22, a personal computer of an operator, a remote cloud computer). Referring again to FIG. 2, a measured depth of the perforation point 80 in the treatment well 14B may be obtained from a fracturing design. This may be used to select a channel range along the monitoring well 14A to record the strongest signals corresponding to this stage. In one example, shown in FIG. 4, a strain rate waterfall plot 120 is shown alongside a hydraulic fracturing pumping schedule 122 over units of time. In the strain rate waterfall plot 120, a fracture hit is shown to occur right about 9:05, when strain rate changes from comparatively positive to comparatively negative, represented as a point when the extending region (comparatively positive region) shows a sharp transition from a heart shape to a band pattern. The fracture-hit time can be used to validate, to some extent, the inversion result, because the fracture should have propagated the well-spacing distance at the fracture-hit time.

Indeed, it has been discovered that strain data corresponding to the time before fracture hit may be used to determine characteristics of the propagation of the fracture. Thus, FIG. 5 illustrates a waterfall plot 140 of the strain rate data from the waterfall plot 120 of FIG. 4 and a waterfall plot 142 of strain data obtained by integrating the strain rate data of the waterfall plot 140.

Figure 5:
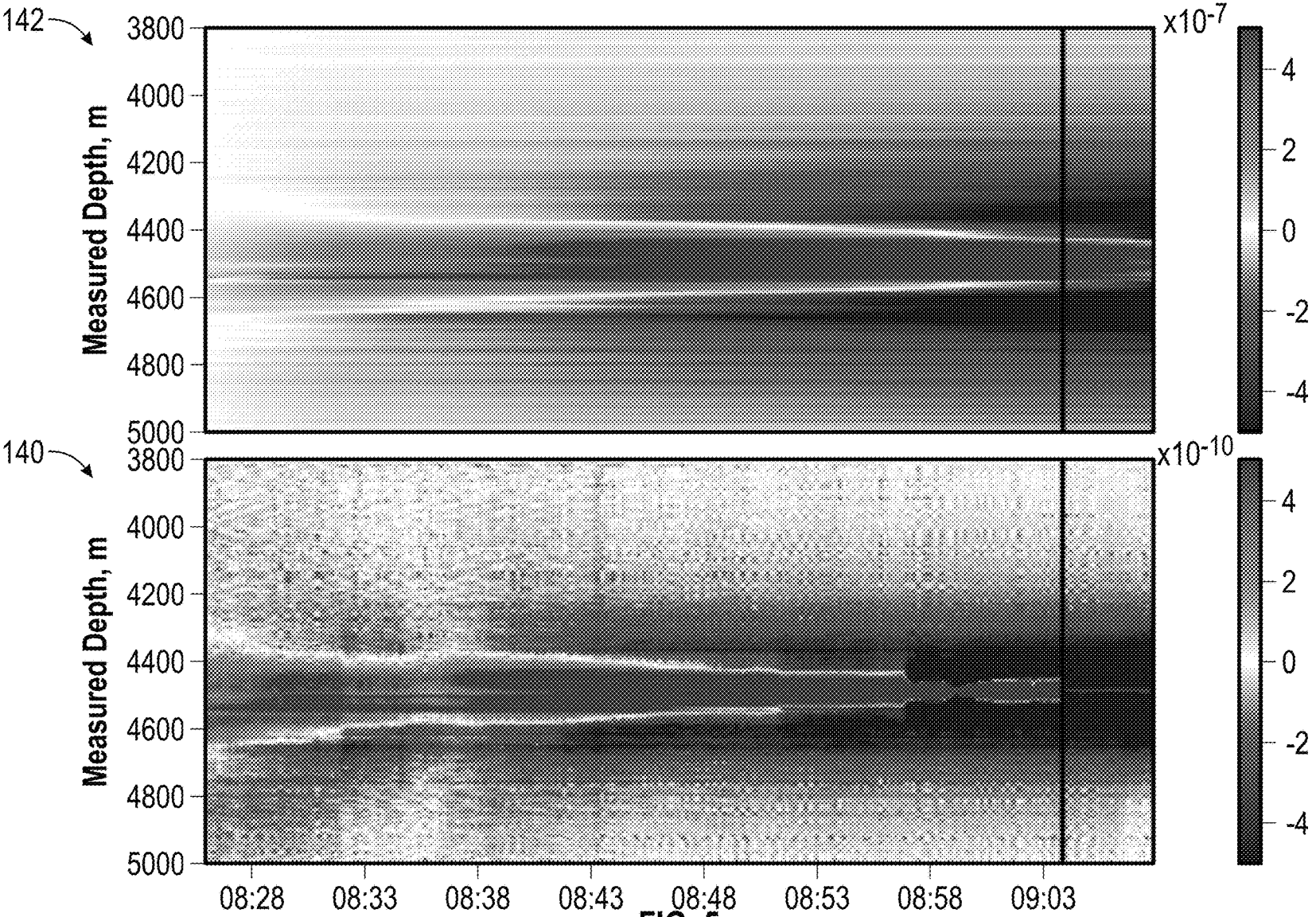
FIG. 5 is a collection of waterfall plots showing fiber-optic strain and strain rate measured while hydraulic fracturing takes place in a treatment well.

The strain data of the waterfall plot 142 of FIG. 5 may be represented as the data used in the inversion, which may be represented as a value d. The inversion may be a gradient-based inversion method. Gradient-based inversion involves the calculation of 'modeled data', which is adjusted (e.g., optimized) to reach a close match with the 'data'. In the method of this disclosure, modeled strain along a horizontal monitoring well is calculated using a 3D displacement discontinuity method (3D DDM), which can be expressed as:

$$\varepsilon = Gw,$$

where G is a Green-function matrix that is dependent on the fracture height (H) and fracture length (L) and w represents the fracture width vector. Therefore, the residual function can be written as:

$$\epsilon = \varepsilon - d.$$

Note that, additionally or alternatively, other methods such as finite element method may be used for the modeling of strains.

In this method, the unknown parameters are the fracture length (L) at each time step and fracture width distribution (w) along the fracture length, while the fracture height is a pre-defined fixed value. The fracture length can be divided into sub-elements with a pre-defined element size ($l_i$), where $L=\Sigma_{i=1}^{N} l_i$ and N is the element number. The fracture width distribution can be further constrained based on some physical understanding of fracture geometry. For example, the fracture width distribution along the fracture length can be assumed to be constant, elliptical, penny shape, or any other reasonable distribution. Thus, the width vector w can be expressed as a function of width at perforation point ($w_0$) and a shape operator (S), i.e., $w=Sw_0$. The final residual function can be written as:

$$\epsilon = GSw_0 - d,$$

and the model parameters are reduced to L and $w_0$. Because the Green-function matrix G depends on the unknown parameter L, the relation between modeled strain and model parameters (e.g., L and $w_0$) is not strictly linear. As such, this means that iterative reduction of residual (e.g., optimization) with an initial guess on the model parameters is performed. The direct inversion results (e.g., L and $w_0$) include fracture parameters including fracture geometry (e.g., fracture half-lengths and fracture widths at the perforation point) as a function of monitoring time. Using the fracture geometry as a function of monitoring time enables determination of secondary information, such as fracture propagation velocity and fracture cross-section area/volume. These values may be obtained based on the inversion result (e.g., L and $w_0$) and fracture shape operator (S).

In the proposed method, a constant fracture height (H) is assumed. Therefore, the problem is simplified as the reduction of residual between modeled strain modeled strain (ε) and field strain data (d) (e.g., optimization of $w_0$ and Z to minimize the residual between modeled strain (ε) and field strain data (d)) within a bounded region defined by $w_{0,min}$, $w_{0,max}$, $L_{min}$ and $L_{max}$, written as:

$$\min\{f(L, w_0) : L_{min} \le L \le L_{max}, w_{0,min} \le w_0 \le w_{0,max}\},$$

where $f=GSw_0-d$. Because G depends on the unknown parameter L, it is nontrivial to explicitly calculate G. Iterative optimization with an initial guess on the model parameters is therefore performed. In this disclosure, a subspace, interior, and conjugate gradient method may be used, such as one developed by Branch et al. (e.g., as described in the article "A subspace, interior, and conjugate gradient method for large-scale bound-constrained minimization problems." *SIAM Journal on Scientific Computing,* 21 (1), 1-23, 1999) to solve the optimization problem of the inversion.

Figure 6:
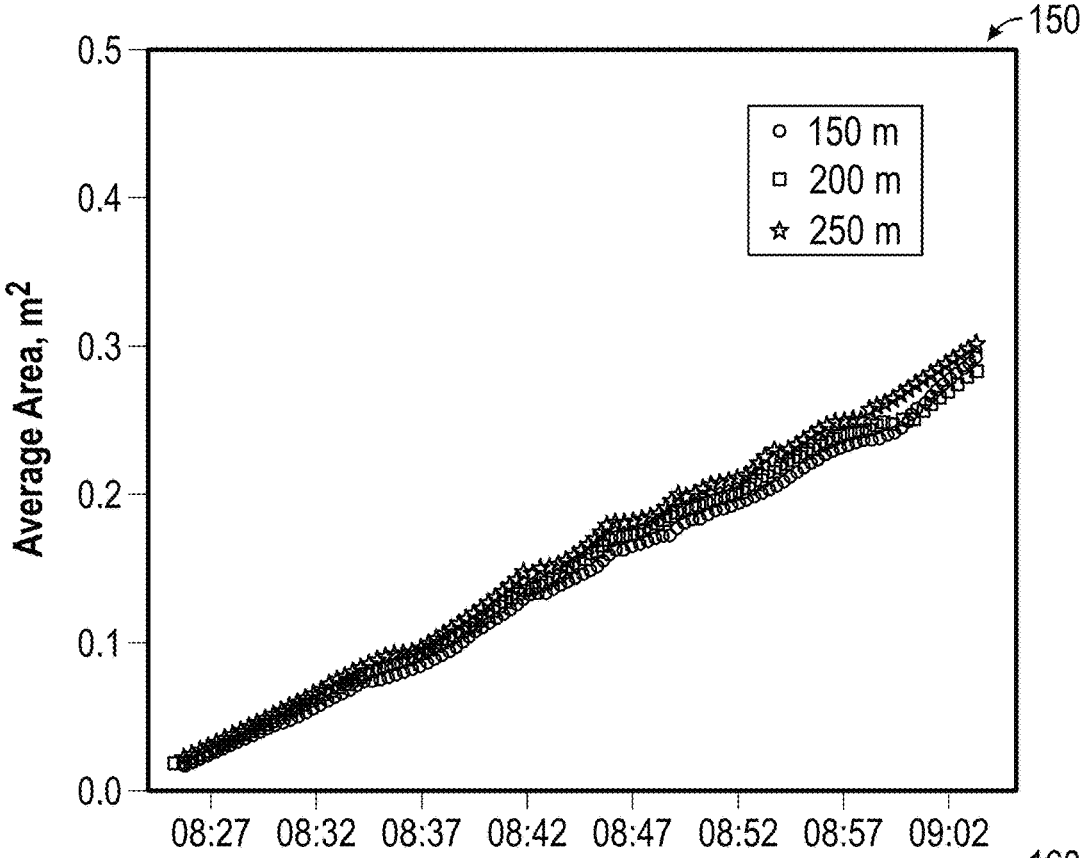
FIG. 6 is a plot of fracture cross-section area as a function of monitoring time as determined based on an inversion of fiber-optic strain data.
Figure 7:
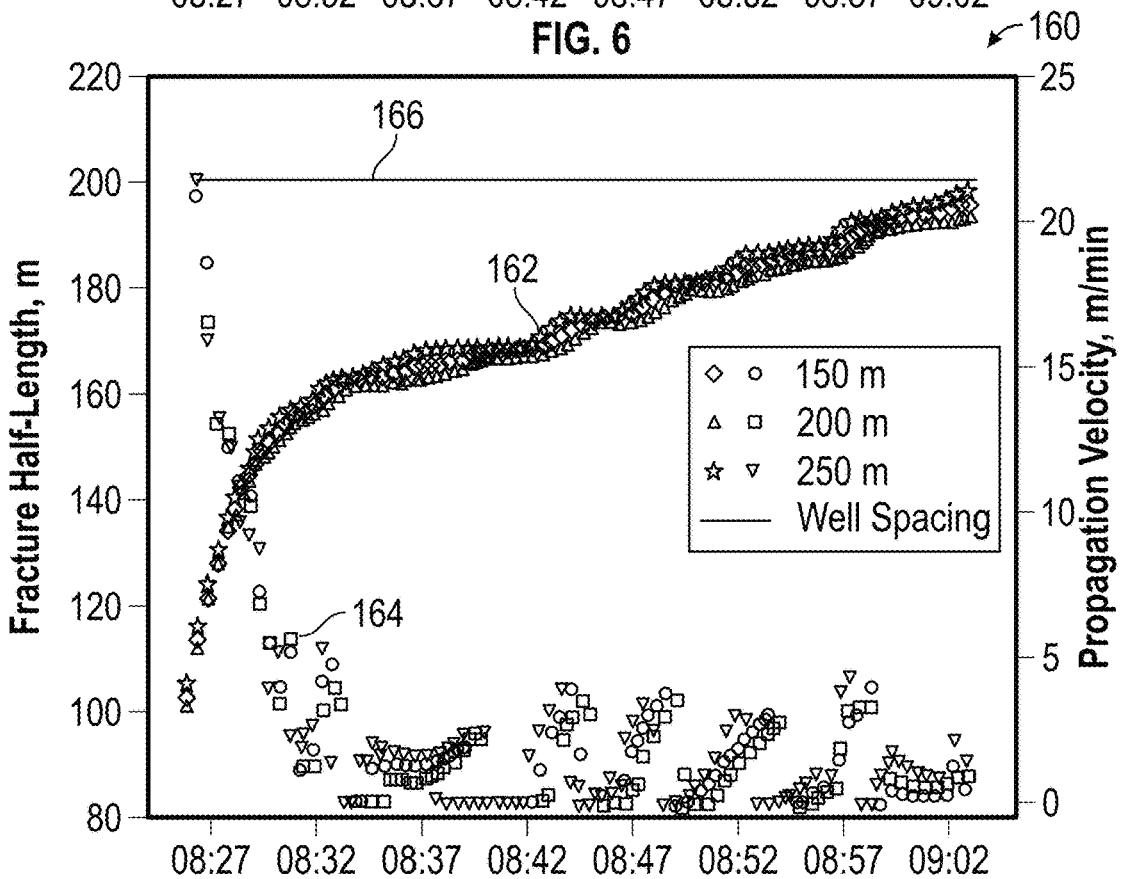
FIG. 7 is a plot of fracture half-length and propagation velocity as a function of monitoring time as determined based on an inversion of fiber-optic strain data.

FIGS. 6-9 illustrate plots of example fracture parameters that may be obtained based on inversions of the strain data of FIG. 5 using the technique discussed above and assuming three different fracture heights H (150 m, 200 m, and 250 m). Resulting data points in FIGS. 6-9 have different shapes based on the inversion data set that they derive from. Circles correspond to data based on an inversion computed using an estimated fracture height of 150 m, squares correspond to data based on an inversion computed using an estimated fracture height of 200 m, and stars correspond to data based on an inversion computed using an estimated fracture height of 250 m. FIG. 6 is a plot 150 illustrating fracture cross-sectional area over time based on the inversions. As seen in the plot 150, for each estimate of height (e.g., 150 m, 200 m, and 250 m), the inversion of the strain data results in a steadily increasing fracture cross-sectional area over time. FIG. 7 is a plot 160 illustrating fracture half-length 162 and propagation velocity 164 as a function of monitoring time. A black solid horizontal line 166 in the plot 160 corresponds to the well spacing between the treatment well and the monitoring well (e.g., in FIG. 2, the distance between the treatment well 14B and the monitoring well 14A at the fracture-hit location 84). Recall that, in the plot 120, the fracture-hit time is shown to be around 9:05 am, which means the fracture half-length at this moment should be the well spacing. The inverted fracture half-length 162 evolution shown in the plot 160 of FIG. 7 indicates that the fracture has propagated about 200 m at the fracture-hit time 9:05, which verifies that the inversion result is sufficiently accurate. In some embodiments, the inversion may be repeated with different initial conditions if the inverted fracture half-length at the fracture-hit time is not within some threshold distance from the well spacing.

Figure 8:
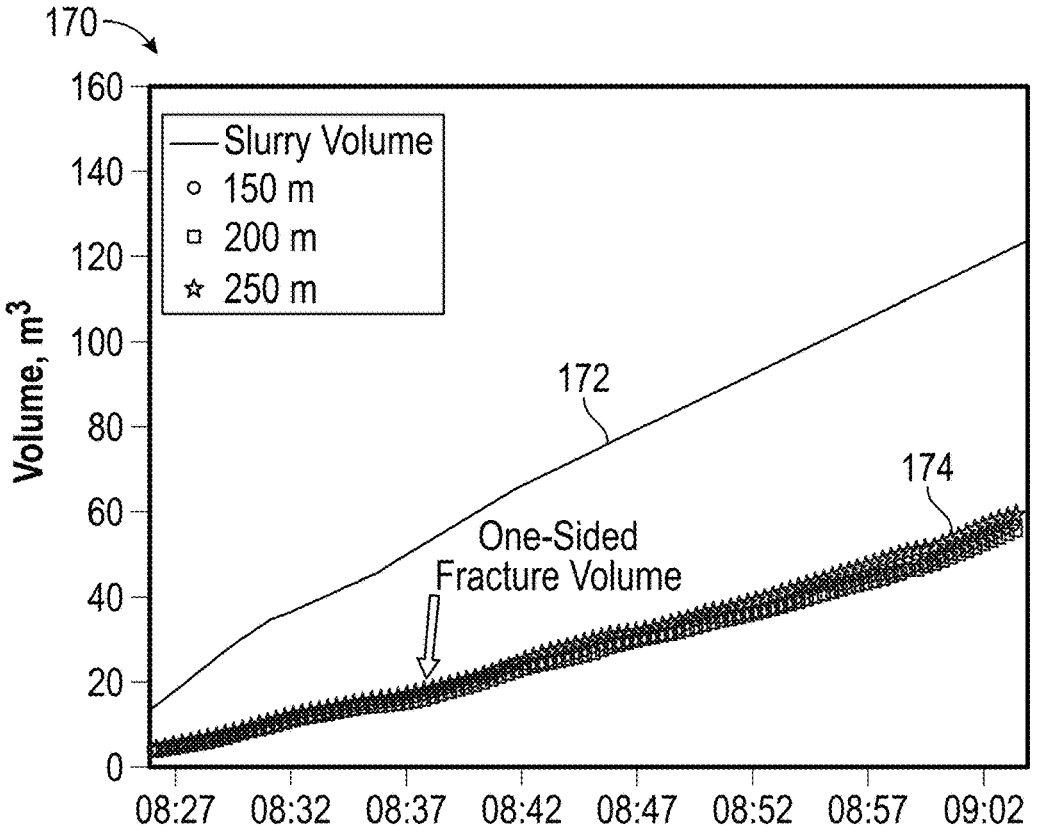
FIG. 8 is a plot of slurry injection volume and one-sided fracture volume as a function of the monitoring time as determined based on an inversion of fiber-optic strain data.
Figure 9:
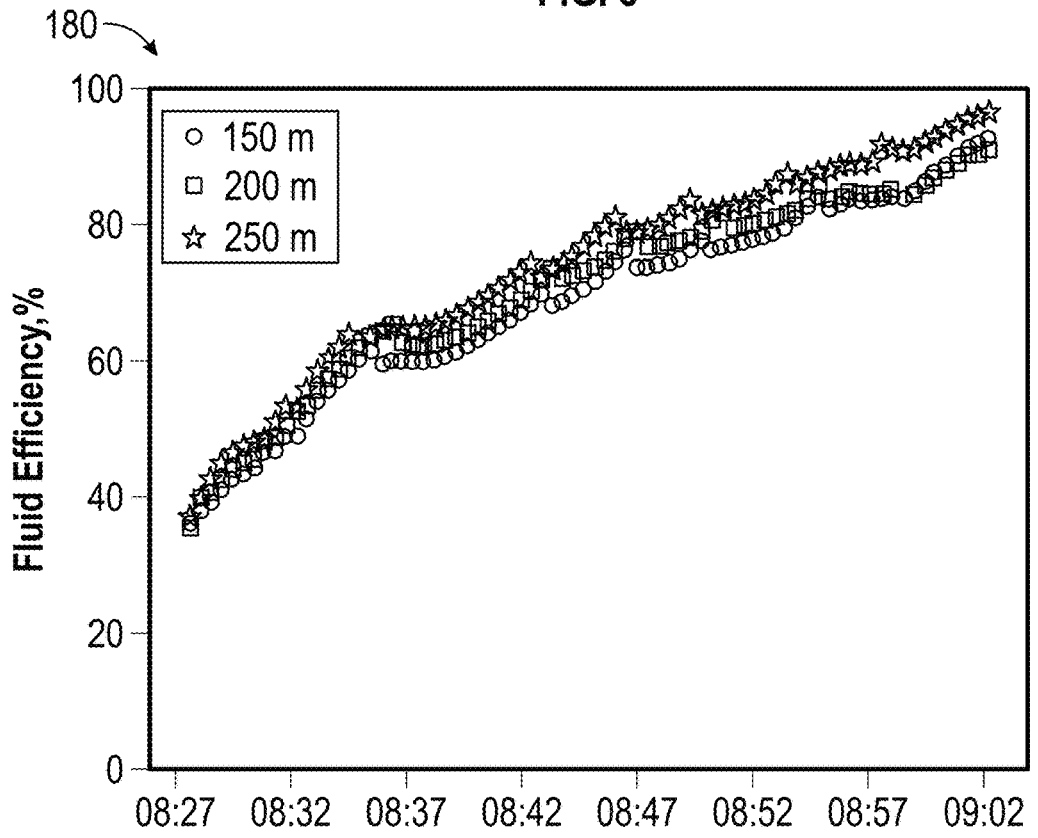
FIG. 9 is a plot of fracturing fluid efficiency as a function of monitoring time, assuming symmetric fracture geometry.

A plot 170 of FIG. 8 shows injected slurry volume 172 of the hydraulic fracturing operation and one-sided fracture volume 174 as a function of monitoring time. Since the monitoring well 14A is only located on one side of the treatment well 14B, little information can be obtained with confidence on the other wing of the hydraulic fracture as the fracture is not always symmetric. Therefore, fracturing fluid efficiency may inform the symmetric (or non-symmetric) nature of the fracture. Fracturing fluid efficiency can be calculated by dividing the total injection volume by the fracture volume if there are monitoring wells on both sides of the treatment well. If one assumes a symmetric fracture, a plot 180 of FIG. 9 shows the fracturing fluid efficiency as a function of monitoring time. The trend does not appear to make sense—the fracturing fluid efficiency should show a decreasing trend as more fluid leaks off into the formation. Nevertheless, the abnormal fracturing fluid efficiency obtained based on the inversion results from one side of the treatment well and an assumption that the fracture is symmetric could indirectly indicate a non-symmetric hydraulic fracture. Indeed, the inversion of strain data from a monitoring well during hydraulic fracturing of a treatment well can (1) provide novel insights on the dynamics of fracture-tip advancement, (2) provide field evidence to support the development/improvement of fracture-propagation models, (3) quantify of the duration of the quiescent period during intermittent fracture propagation that represents a proxy for an in-situ indicator of where the injected fluid is and of heterogeneity in rock properties, (4) estimate the fracture cross-section area and fracture volume, and (5) calculate fracturing fluid efficiency evolution that can be an indicator of whether fracture propagation is symmetric or not.

Language of degree used herein, such as the terms "approximately," "about," "generally," and "substantially" as used herein represent a value, amount, or characteristic close to the stated value, amount, or characteristic that still performs a desired function or achieves a desired result. For example, the terms "approximately," "about," "generally," and "substantially" may refer to an amount that is within less than 10% of, within less than 5% of, within less than 1% of, within less than 0.1% of, and/or within less than 0.01% of the stated amount. As another example, in certain embodiments, the terms "generally parallel" and "substantially parallel" or "generally perpendicular" and "substantially perpendicular" refer to a value, amount, or characteristic that departs from exactly parallel or perpendicular, respectively, by less than or equal to 15 degrees, 10 degrees, 5 degrees, 3 degrees, 1 degree, or 0.1 degree.

Although a few embodiments of the disclosure have been described in detail above, those of ordinary skill in the art will readily appreciate that many modifications are possible without materially departing from the teachings of this disclosure. Accordingly, such modifications are intended to be included within the scope of this disclosure as defined in the claims. It is also contemplated that various combinations or sub-combinations of the specific features and aspects of the embodiments described may be made and still fall within the scope of the disclosure. It should be understood that various features and aspects of the disclosed embodiments can be combined with, or substituted for, one another in order to form varying modes of the embodiments of the disclosure. Thus, it is intended that the scope of the disclosure herein should not be limited by the particular embodiments described above.

The techniques presented and claimed herein are referenced and applied to material objects and concrete examples of a practical nature that demonstrably improve the present technical field and, as such, are not abstract, intangible or purely theoretical. Further, if any claims appended to the end of this specification contain one or more elements designated as "means for [perform]ing [a function] . . . " or "step for [perform]ing [a function] . . . ", it is intended that such elements are to be interpreted under 35 U.S.C. 112(f). However, for any claims containing elements designated in any other manner, it is intended that such elements are not to be interpreted under 35 U.S.C. 112(f).

The invention claimed is:

1. A system comprising:

a fiber-optic strain sensor configured to be disposed downhole in a monitoring well to obtain strain data while a fracture, caused by a hydraulic fracturing operation in an adjacent treatment well, propagates from the treatment well toward the monitoring well, the strain data obtained even before a fracture hit occurs in the monitoring well, wherein obtaining the strain data comprises:

measuring strain rate data; and integrating the strain rate data over a time period to obtain the strain data; and processing circuitry configured to:

perform an inversion based on the strain data to estimate fracture parameters associated with the propagation of the fracture even before the fracture hit occurs in the monitoring well, wherein the performing the inversion to estimate the fracture parameters comprises:

calculating a modeled strain using a 3D displacement discontinuity method (3D DDM), wherein the modeled strain is a function of a height of the fracture, a width of the fracture, and a length of the fracture;

performing a gradient-based inversion by iteratively reducing a residual between the modeled strain and the strain data; and estimating, based on the gradient-based inversion, the fracture parameters before the fracture hit occurs in the monitoring well.

2. The system of claim 1, wherein the strain sensor comprises a low-frequency distributed acoustic sensing (LF-DAS) fiber-optic sensor.

3. The system of claim 1, wherein the fracture parameters comprise a fracture half-length.

4. The system of claim 1, wherein the fracture parameters comprise a fracture propagation velocity.

5. The system of claim 1, wherein the fracture parameters comprise a fracture cross-section area.

6. The system of claim 1, wherein the fracture parameters comprise a fracture volume.

7. The system of claim 1, wherein the fracture parameters comprise a fracturing fluid efficiency.

8. The system of claim 1, wherein the processing circuitry is configured to estimate the fracture parameters by:

determining a fracture half-length and fracture width distribution from the inversion; and determining, based on the fracture half-length and the fracture width distribution, a fracture propagation velocity, a fracture cross-section area, a fracture volume, a fracturing fluid efficiency, or any combination thereof.

9. The system of claim 1, wherein the monitoring well is disposed a well spacing from the treatment well, and wherein the processing circuitry is configured to validate the fracture parameters by verifying that a fracture half-length of the fracture is within a threshold distance of the well spacing at a time the fracture hit occurs.

10. The system of claim 1, where the fracture hit comprises a fracture extending from the treatment well into the monitoring well.

11. A method comprising:

positioning a fiber-optic strain sensor in a monitoring well;

performing a hydraulic fracturing operation in a treatment well positioned adjacent the monitoring well;

obtaining strain data from the fiber-optic strain sensor positioned in the monitoring well, wherein obtaining the strain data comprises:

measuring strain rate data; and integrating the strain rate data over a time period to obtain the strain data;

performing an inversion on a portion of the strain data from the fiber-optic strain sensor obtained during the hydraulic fracturing operation between a fracture perforation of the treatment well and even before a fracture hit of the monitoring well, wherein the performing the inversion comprises:

calculating a modeled strain using a 3D displacement discontinuity method (3D DDM), wherein the modeled strain is a function of a height of the fracture, a width of the fracture, and a length of the fracture; and performing a gradient-based inversion by iteratively reducing a residual between the modeled strain and the strain data; and estimating, based on the gradient-based inversion, a fracture parameter of the performed hydraulic fracturing operation before the fracture hit occurs in the monitoring well.

12. The system of claim 1, wherein the modeled strain is denoted (E), wherein the strain data is denoted (d), and wherein the gradient-based inversion comprises determining an optimization of $w_0$ and L to minimize a residual between (ε) and (d) based on a residual function $\varepsilon = GSw_0 - d$, where G is a Green-function matrix that depends on L, S is a shape operator, $W_0$ is a width of a perforation point of the fracture, and L is a length of the fracture.

13. The system of claim 12, wherein the optimization of w, and L are determined within a bounded region $\min\{f(L, w_0): L_{min} \le L \le L_{max}, w_{0,min} \le w_0 \le w_{0,max}\}$, where $f = GSw_0 - d$.

14. The method of claim 11, where the fracture hit comprises a fracture extending from the treatment well into the monitoring well.

15. The method of claim 11, wherein the fracture parameter comprises a fracture half-length, a fracture propagation velocity, a fracture cross-section area, a fracture volume, a fracturing fluid efficiency, or any combination thereof.

16. The method of claim 11, comprising adjusting the hydraulic fracturing operation based on the fracture parameter.

17. The method of claim 16, wherein adjusting the hydraulic fracturing operation comprises adjusting a pumping pressure, adjusting a pumping rate, pausing pumping, stopping pumping, or any combination thereof.

* * * * *